US011988378B2

(12) United States Patent
Laroche et al.

(10) Patent No.: US 11,988,378 B2
(45) Date of Patent: May 21, 2024

(54) BURNER AND ASSEMBLY OF COMPACT BURNERS

(71) Applicant: FIVES PILLARD, Marseilles (FR)

(72) Inventors: Pascal Laroche, Saint-Zacharie (FR); Fouad Said, Marseilles (FR)

(73) Assignee: FIVES PILLARD, Marseilles (FR)

( * ) Notice: Subject to any disclaimer, the term of this patent is extended or adjusted under 35 U.S.C. 154(b) by 285 days.

(21) Appl. No.: 16/760,275

(22) PCT Filed: Nov. 29, 2018

(86) PCT No.: PCT/FR2018/053051
§ 371 (c)(1),
(2) Date: Apr. 29, 2020

(87) PCT Pub. No.: WO2019/122566
PCT Pub. Date: Jun. 27, 2019

(65) Prior Publication Data

US 2020/0309364 A1 Oct. 1, 2020

(30) Foreign Application Priority Data

Dec. 21, 2017 (FR) ..... 1762740

(51) Int. Cl.
*F23D 14/02* (2006.01)
*F23D 14/64* (2006.01)
(Continued)

(52) U.S. Cl.
CPC ..... *F23D 14/02* (2013.01); *F23D 14/64* (2013.01); *F23D 14/70* (2013.01); *F23D 14/84* (2013.01);
(Continued)

(58) Field of Classification Search
CPC .... F23D 14/34; F23D 14/48; F23D 2203/007; F23D 2900/00015; F23D 2900/14701;
(Continued)

(56) References Cited

U.S. PATENT DOCUMENTS 3,954,386 A * 5/1976 Harpenslager ..... F23G 7/065 431/353
5,193,346 A 3/1993 Kuwata
(Continued)

FOREIGN PATENT DOCUMENTS

CN 104501208 A 4/2015
EP 0686812 A1 12/1995
(Continued)

OTHER PUBLICATIONS

International Search Report for corresponding application PCT/FR2018/053051 filed Nov. 29, 2018; dated Feb. 19, 2019.

*Primary Examiner* — Vivek K Shirsat
(74) *Attorney, Agent, or Firm* — CANTOR COLBURN LLP

(57) ABSTRACT

A premix burner made up of an air inlet tube of length L and a single specific gas injection, the gas injection includes an upstream gas injector, a mixer, a downstream gas injection situated at a distance L3 from an upstream end of the air inlet tube and a stabilizing element, where the gas injection constitutes a one-piece mechanical assembly that ensures a self-stable elementary flame.

19 Claims, 12 Drawing Sheets

(51) Int. Cl.
*F23D 14/70* (2006.01)
*F23D 14/84* (2006.01)
*F23D 23/00* (2006.01)

(52) U.S. Cl.
CPC ..... *F23D 23/00* (2013.01); *F23D 2203/007* (2013.01); *F23D 2205/00* (2013.01)

(58) Field of Classification Search
CPC ..... F23D 14/62; F23D 2900/14004; F23D 2900/14002; F23D 2900/14642; F23D 14/02; F23D 14/64; F23D 14/70; F23D 14/58; F23D 14/46; F23C 6/02
USPC ..... 239/419, 403
See application file for complete search history.

(56) References Cited

U.S. PATENT DOCUMENTS 5,471,840 A 12/1995 Lovett
6,250,913 B1 * 6/2001 Maton ..... F23D 14/62 431/353
7,703,288 B2 * 4/2010 Rogers ..... F23R 3/286 60/737
9,057,517 B1 * 6/2015 Briggs ..... F23C 5/08
9,410,698 B2 * 8/2016 Mori ..... F23D 14/08
2003/0110774 A1 * 6/2003 Saitoh ..... F23R 3/14 60/737
2004/0229178 A1 * 11/2004 Mandai ..... F23R 3/343 431/195
2006/0005542 A1 * 1/2006 Campbell ..... F23C 6/047 60/723
2007/0207426 A1 9/2007 Perry
2008/0134838 A1 * 6/2008 Memoli ..... F23D 14/84 75/553
2009/0226852 A1 9/2009 Feese
2013/0255551 A1 * 10/2013 Xue ..... F23D 1/005 110/297
2016/0186663 A1 * 6/2016 Stewart ..... F23R 3/286 60/737
2017/0030581 A1 * 2/2017 Li ..... B01J 12/00
2017/0261203 A1 * 9/2017 Goh ..... F23C 9/006
2020/0224871 A1 * 7/2020 Pancolini ..... F23D 14/26

FOREIGN PATENT DOCUMENTS

EP 1852656 A1 11/2007
EP 2206957 A2 7/2010
EP 2206957 A3 7/2020
JP 09119639 5/1997
JP 9119639 A 5/1997

* cited by examiner 1
8
12

1
12

BURNER AND ASSEMBLY OF COMPACT BURNERS

TECHNICAL FIELD

The present disclosure relates to a burner and to a set of industrial gas burners. These burners emit nitrogen oxides (NOx), which are sources of pollution.

BACKGROUND

The obtaining of a stable flame with low emission of nitrogen oxides is a major consideration in the development of industrial burners.

There is a need for equipment that is easy to incorporate into existing installations, these installations often having only a single gas inlet and being of small size, making it necessary to have a burner of small size.

Installations have various forms and the burner has to be able to conform as well as possible to the geometries of the combustion chambers.

Also desired are flexibility and thus variations in high charges in order to optimize the consumption of fuel according to needs.

Nevertheless, it is necessary to maintain low emissions of NOx and CO and correct yields.

BRIEF SUMMARY

The subject of the disclosure is a compact gas burner that is based on premix technology and made up of a single gas inlet. This burner constitutes an elementary module that delivers a low NOx and low CO flame that has a controlled form conforming to the form of the combustion chamber.

The subject of the disclosure is also the combination of a plurality of elementary modules in a set that makes it possible to obtain a greater thermal power while maintaining a low level of emissions of NOx and CO. It also makes it possible to increase the variability of the set in order to make it possible to provide more flexibility in the management of the power.

The premix burner according to the disclosure is made up of an air inlet tube of length L and a specific gas injection, said gas injection comprises an upstream gas injector, a mixer, a downstream gas injection situated at a distance L3 from an upstream end of the air inlet tube and a stabilizing element, and is characterized in that the gas injection constitutes a one-piece mechanical assembly that ensures a self-stable elementary flame. The burner is thus more compact and simpler.

Advantageously, the air inlet tube has a length L and a diameter D1 such that the length L is between three and six times the diameter D1. This dimension makes it possible to obtain a burner that is both compact and effective.

Advantageously, the upstream gas injector is situated at a distance L1 from an upstream end of the air inlet tube of between 0.5 times the diameter D1 and the length L.

Advantageously, the upstream gas injector comprises at least two elements of axes x and x' that are disposed radially with respect to the air inlet tube, each element having gas injection holes disposed along its axis.

Advantageously, the upstream gas injector comprises at least two mixing elements of axes y and y' that are inclined with respect to the radius of the air inlet tube and connect the air inlet tube and the gas injection duct, and each mixing element has gas injection holes disposed along its axis y or y'. This makes it possible to simultaneously ensure turbulence that is able to promote the mixing of the gas and the air and to minimize the pressure loss on the air side.

Note that the above upstream gas injector can be used in other types of burners than those described above.

In order to obtain ultra-low NOx performance by using the premix technology, it is necessary not only to supply the gas and the air in specific proportions but also to ensure intimate mixing between the gas and the air over the shortest distance possible.

The current state of the art consists in ensuring the function of gas injection by an injector and the function of mixing by a specific mechanical component (mixer, rosette, etc.) positioned upstream or downstream of the gas injector. The major problem with this implementation lies in the significant pressure loss generated by the mixer, which is incompatible with the user recommendations since it involves choosing more powerful air blowers (cost, power consumption).

The above-described upstream gas injector is directed to ensuring the two functions of gas injection and mixing via a single mechanical component.

The upstream gas injection makes it possible to minimize pressure losses through an aerodynamic form and to create turbulence through a twisted form inclined with respect to the radius of the air inlet tube.

Advantageously, the diffuser is situated at a distance L4 from an upstream end of the air inlet tube of between L and L−D1.

Advantageously, the diffuser has a cross section smaller than or equal to 0.5 times the cross section of the air inlet tube.

Advantageously, the diffuser comprises a stabilizing element of diameter D5 and a concentrator of diameter D8 and length L7, the stabilizing element is pierced by holes distributed in two concentric circles of diameters D6 and D7, D7<D8<D6, and the length L7 is between 0 and D5.

The above combination of the diffuser and the concentrator could be used for other types of burners than those described in the present description.

In order to obtain ultra-low NOx performance by using the premix technology, it is necessary to supply the gas and the air in specific proportions while remaining in the flammability range of the gas to be burnt. For example, the flammability range of methane, which is the main constituent of natural gas, is between 5% and 15%.

If the air factor R is defined by the following formula:

$$R=(Q\text{air})/(Q\text{gas}\times PCO) \text{ where } PCO=\text{stoichiometric air requirement}$$

the flammability range of methane is defined as: $0.66<R<2$

The operation of a burner with an airfactor greater than 2, which makes it possible to obtain even lower NOx values, is not possible with the conventional burners since the flame would not benefit from sufficient stability.

The employment of a downstream gas injection combined with a combination of a stabilizing element and a concentrator, as described above, makes it possible to create a pilot flame by local enrichment with gas, said pilot flame ensuring the stability of the main flame, thereby allowing the air factor to increase above R=2 in order to further reduce NOx.

The stabilizing element is in the form of a cylindrical disc and has a plurality of holes of calibrated cross section that are disposed at different diameters, and of a concentrator mechanically connected to the stabilizing element upstream of the latter.

Advantageously, the downstream gas injection is situated at a distance L3 from an upstream end of the air inlet tube of between L4–(0.5×D1) and L4.

Advantageously, the air inlet tube is prolonged by walls for mechanically protecting the flame.

In certain industrial applications, post-combustion burners are mounted downstream of the gas turbines (cogeneration). When the turbine is at rest, the burners have to be able to operate in fresh-air mode while complying with environmental regulations in force (NOx and CO). In this operating mode, the burners have the function of heating up large volumes of air. The set of burners that is the subject of the present disclosure makes it possible to obtain low NOx values by virtue of the premix technology. At the same time, in order to limit CO emissions to below the regulatory values, the premix flames have to be protected from the flow of fresh air coming from the sheath, in order to avoid rapid cooling of the flame (quenching), which causes the formation of gaseous unburnt residues (CO).

The employment of walls for mechanically protecting the flame makes it possible to impede the mixing of large volumes of fresh air and the flame, thereby limiting the formation of CO.

Advantageously, the walls for mechanically protecting the flame have a diameter D2 of between the diameter D1 of the air inlet tube and 5×D1.

Advantageously, the walls for mechanically protecting the flame have an inclination angle α2 with respect to the axis of the burner of between 0° and 20°.

Advantageously, a peripheral gas injection is situated at a distance L6 from an upstream end of the air inlet tube such that:

$$0 \leq (L-L6) \leq 2 \times D1.$$

In conjunction with the premix technology and in order to reduce the excess air to exploitable proportions, a gas injection is disposed at the periphery of the air inlet tube. This peripheral gas injection, which is necessary in certain industrial applications, is realized so as to:

- keep the rise in emissions of nitrogen oxides below the regulatory values;
- limit the lengthening of the flame in the combustion chamber.

The possibility of setting the peripheral gas injection back with respect to the air inlet tube makes it possible to limit the action of the two above-described phenomena.

Advantageously, the mixer is situated at a distance L2 from an upstream end of the air inlet tube such that:

$$(L-L3) \leq (L-L2) \leq L.$$

Advantageously, the mixer has a cross section smaller than or equal to 0.5 times the cross section of the air inlet tube.

Advantageously, the set of burners comprises a second, secondary air tube of diameter D4 that is concentric with the air tube of diameter D1 such that D4>D1. The injection of gas into the annular space between the air inlet tube and the second tube makes it possible to draw in, by the Venturi effect, a part of the airflow necessary for premix combustion, thereby making it possible to reduce the total pressure loss of the burner and to increase the power of the burner.

Advantageously, an intermediate gas injection is situated at a distance L8 from the upstream end of the air inlet tube such that L8>0.

The set according to the disclosure is characterized in that it comprises a number Nmax of burners, said burners having at least one of the above features. It is possible to choose a suitable embodiment for the combustion chamber and to make it possible to obtain a set with greater power. The burners are preferably juxtaposed in the firebox and can have a plurality of gas inlets or a single inlet for all.

Advantageously, the number Nmax of burners deliver a power of between Pmax and Pmin, the set is able to function with a number Nmin of burners, and its power is variable depending on the number N of burners in operation, such that its variation in power Vp=(Nmax×Pmax)/(Nmin×Pmin). The variation in power (or charge) of a set of burners is an important parameter for the user, since it makes it possible to confer operating flexibility on the installation. The maximum power is defined depending on need while the minimum power is defined in accordance with the technically achievable possibilities. For a given maximum power, the lower the minimum charge, the greater the variation in power and the more flexible the installation.

For example, in the summer period in urban boiler rooms, a low minimum charge makes it possible to avoid ill-timed on/off cycles of the burner and thus to save energy.

The variation in power Vp is defined by the ratio of the maximum power Pmax to the minimum power Pmin such that Vp=Pmax/Pmin.

In the case of an installation comprising a plurality of burners of equivalent power P that can vary from Pmin to Pmax, the variation in power Vp of the set also depends on the maximum number of burners in service Nmax and on the minimum number of burners in service Nmin, such that Vp=(Nmax×Pmax)/(Nmin×Pmin).

Advantageously, the set of burners comprises m peripheral gas injections, such that m>1. This makes it possible to obtain a set with greater power for the same size. The gas injection associated with the set of burners has the aim of reducing the excess air to exploitable proportions and of limiting the lengthening of the flame in the combustion chamber. This gas injection is disposed at the periphery of the set of burners and can be set back upstream of the air inlet tube.

In certain applications in the minerals industry, the use of this type of burner using the premix technology with air factors R of between 0.25 and 1 makes it possible to reduce the nitrogen oxides by way of two phenomena:

- by generating a flame in which the NOx produced are converted into molecular nitrogen by the "reburning" effect via complex chemical mechanisms represented schematically as follows:
  - CH4→CHi radicals (in the reducing zone)
    - CHi+NO→HCN
    - HCN+NO→N2
- by creating a short flame that is perfectly attached to the tip of the burner without an ignition distance of the mixture. The absence of an ignition zone of the mixture prevents the secondary air from being involved in the combustion in the primary zone, and limits the formation of NOx.

BRIEF DESCRIPTION OF THE DRAWINGS

Further advantages still may become apparent to a person skilled in the art on reading the following examples, illustrated by the appended figures, which are given by way of example.

DETAILED DESCRIPTION

In the rest of the description, the term upstream will be used for the part of the burner that is situated further forward with respect to the stream of gas or to the stream of air, and the term downstream will be used for the part situated further away in the direction of said stream.

Figure 1A:
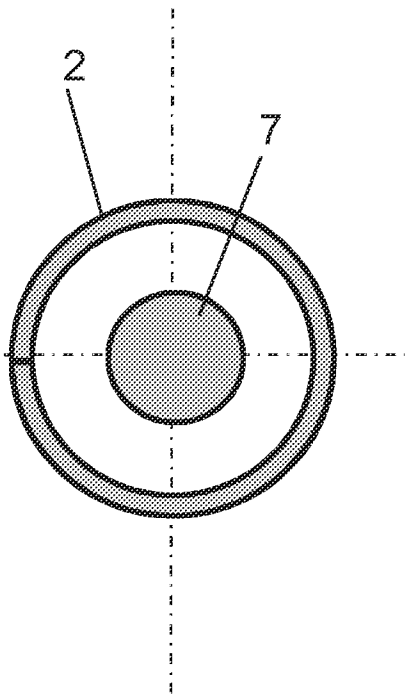
FIG. 1*a* is a frontal view of the burner in FIG. 1.
Figure 1:
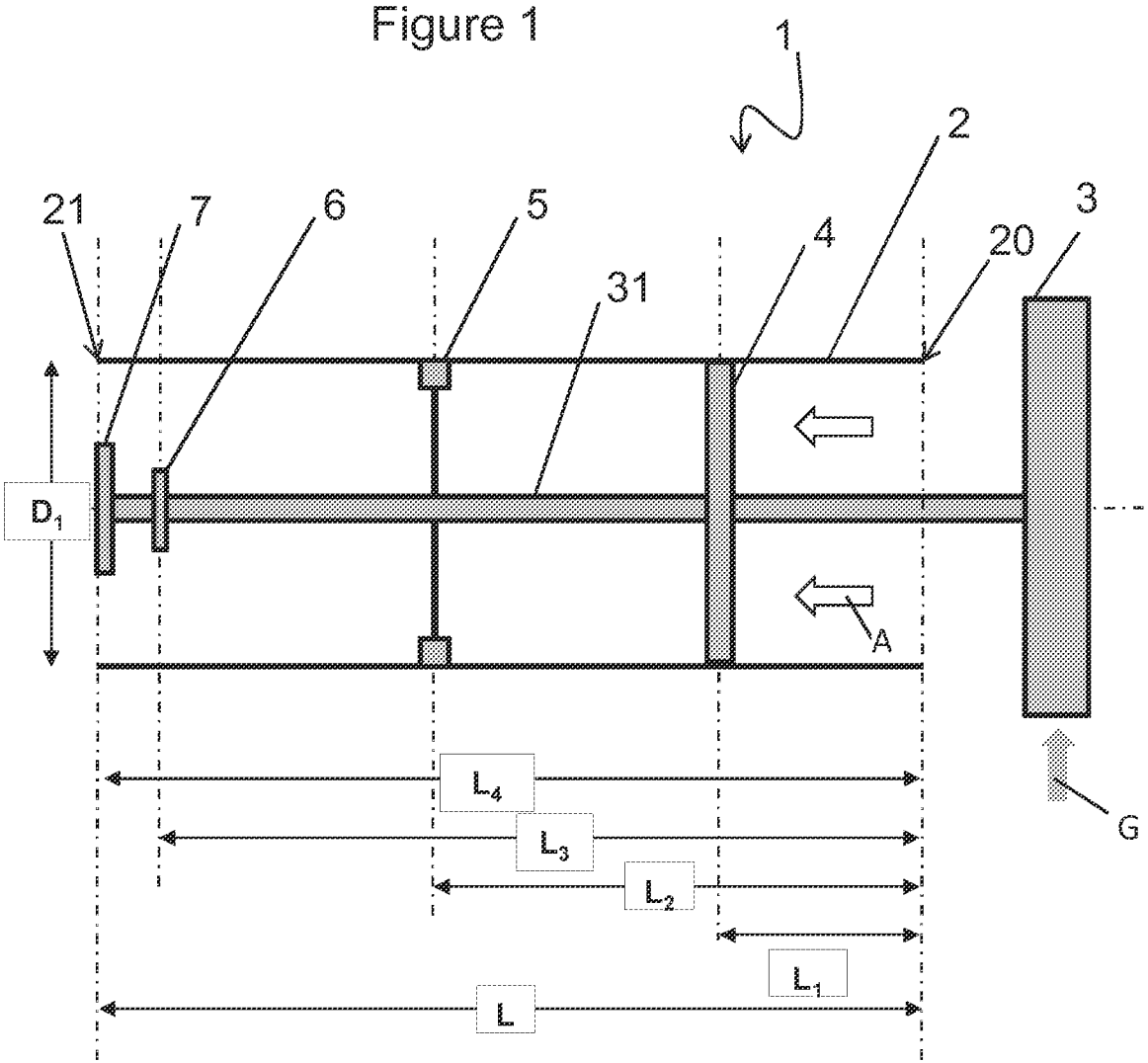
FIG. 1 shows a cross section of a burner according to the disclosure.

The burner 1 illustrated in FIG. 1 comprises an air inlet tube 2 of length L and axis Z, and a one-piece specific gas injection system 3 that is made up of several elements:

- a gas inlet duct 31 situated in the air inlet tube 2,
- an upstream gas injection 4 situated in the air inlet tube 2 at a distance L1 from the upstream end 20 of said tube 2,
- a downstream gas injection 6 situated at a distance L3 from the upstream end 20 of the air inlet tube 2 and inside the latter,
- an air/gas mixing element 5 situated inside the air inlet tube 2 at a distance L2 from the upstream end of said tube 2,
- a stabilizing element such as an air/gas diffuser 7 situated at a distance L4 from the end of the air inlet tube 2.

The gas arrives along the arrow G and the air along the arrow A and the secondary air along the arrow A2. The gas arrives via the specific gas injection system 3, passing through the duct 31 so as to exit through the upstream gas injection 4 and the downstream gas injection 6. For its part, the air flows through the air inlet tube 2.

Figure 6:
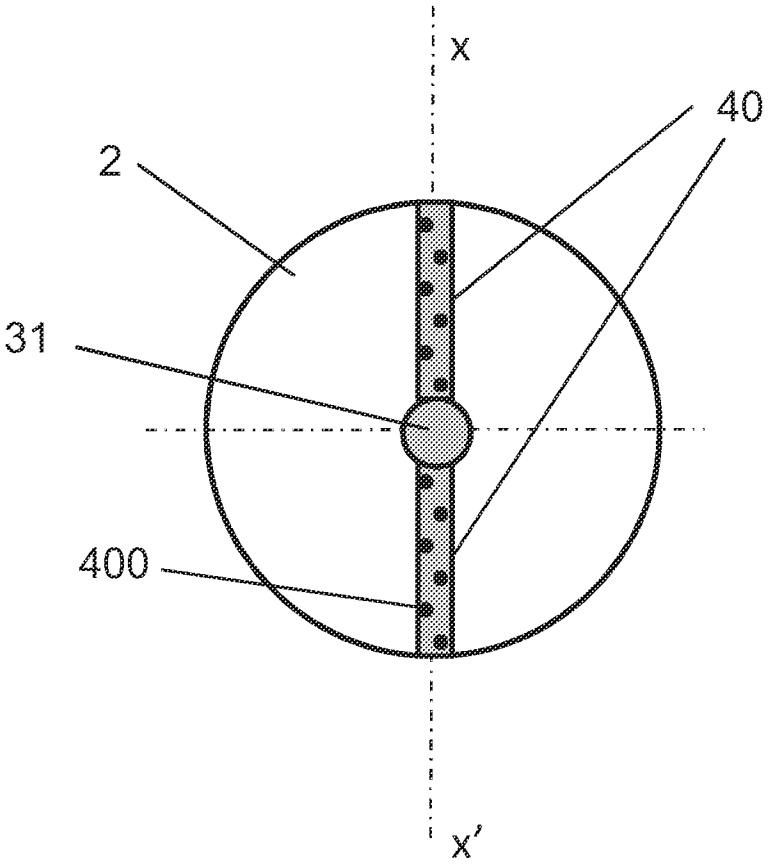
FIG. 6 is a frontal view of the air inlet with gas injections according to a first embodiment.
Figure 7:
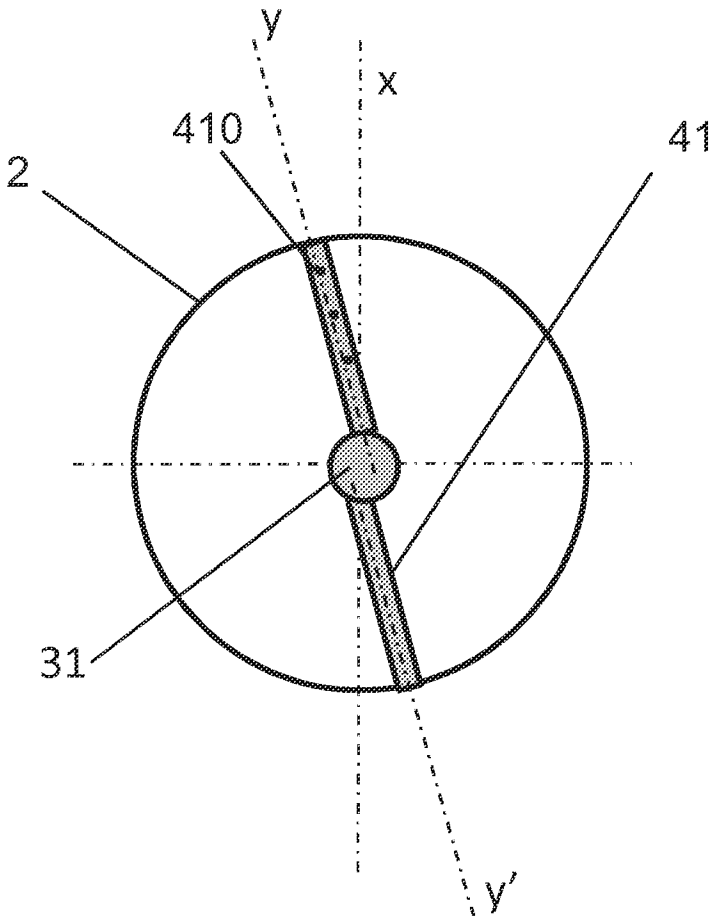
FIG. 7 is a frontal view of the air inlet with gas injections according to a second embodiment.

The upstream gas injection 4 is illustrated in detail in FIGS. 6 and 7.

In the example illustrated in FIG. 6, it comprises two elements 40 that are disposed radially. They each start from the gas inlet duct 31 and extend as far as the air inlet tube 2. These elements 40 are perforated with holes 400 disposed in the downstream part. The holes 400 are either aligned at the middle or at the sides, or are distributed in a staggered manner as in FIG. 6.

Figure 4:
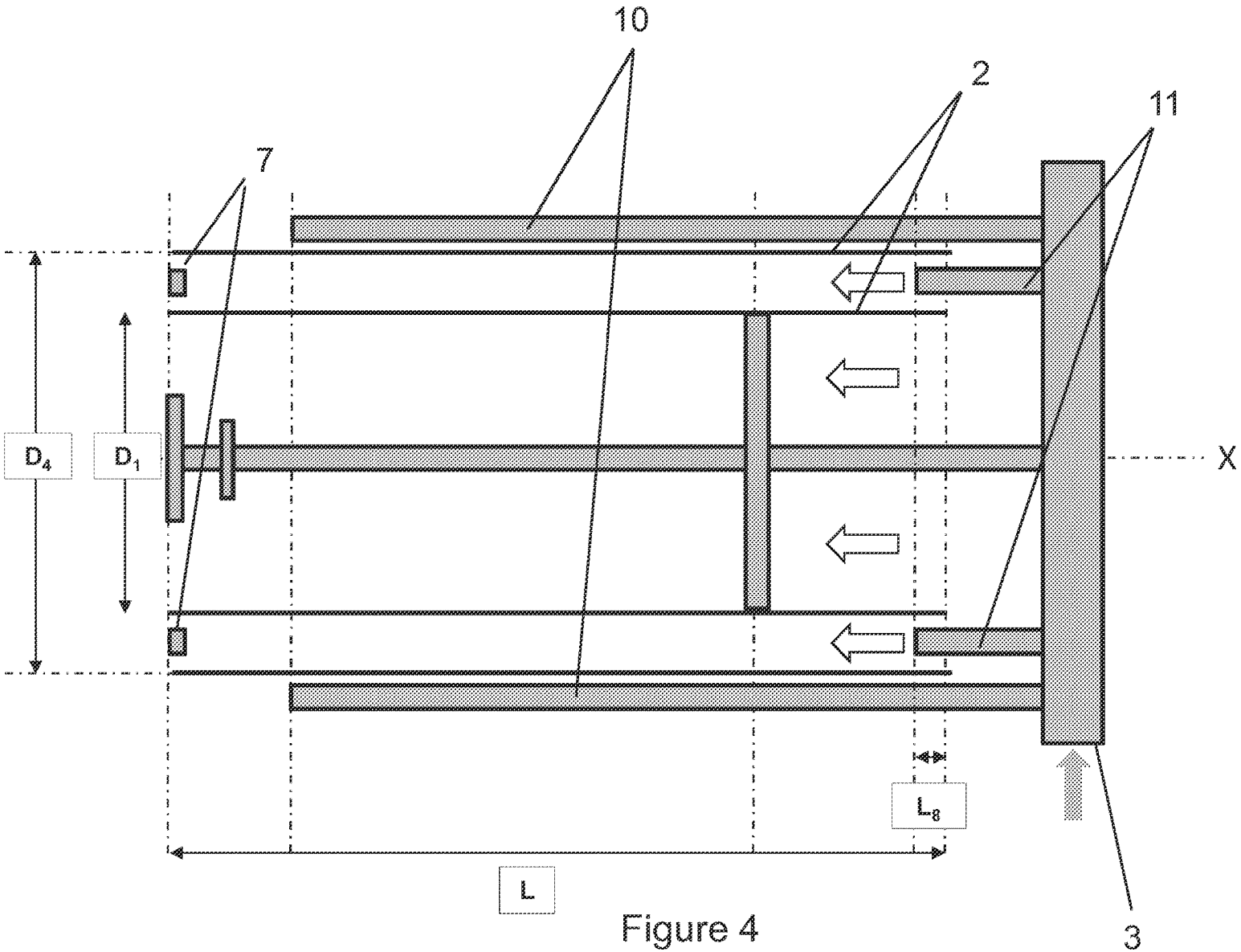
FIG. 4 is a cross section of a burner with a concentric second air tube.

According to the variant in FIG. 4, the air inlet tube 2 is surrounded by a second, secondary air inlet tube 22 that is concentric and the same length, intermediate gas injections 11 being disposed in an annular space 23 defined by the two tubes 2 and 22. These intermediate gas injections 11 enter the annular space 23 over a length L8. The length L8 has to be other than zero in order to avoid gas being sent somewhere other than the annular space. Stabilizing elements, such as diffusers 70, are positioned at the outlet of the annular space 23.

Figure 5B:
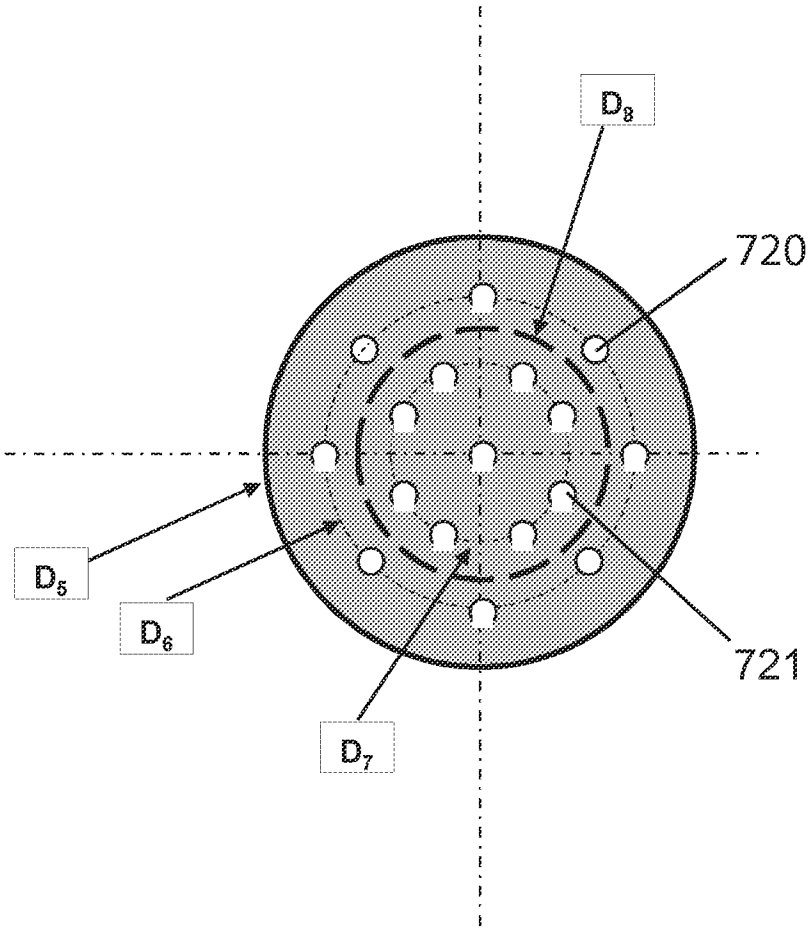
FIG. 5*b* is a frontal view of the diffuser in FIG. 5*a*.
Figure 5A:
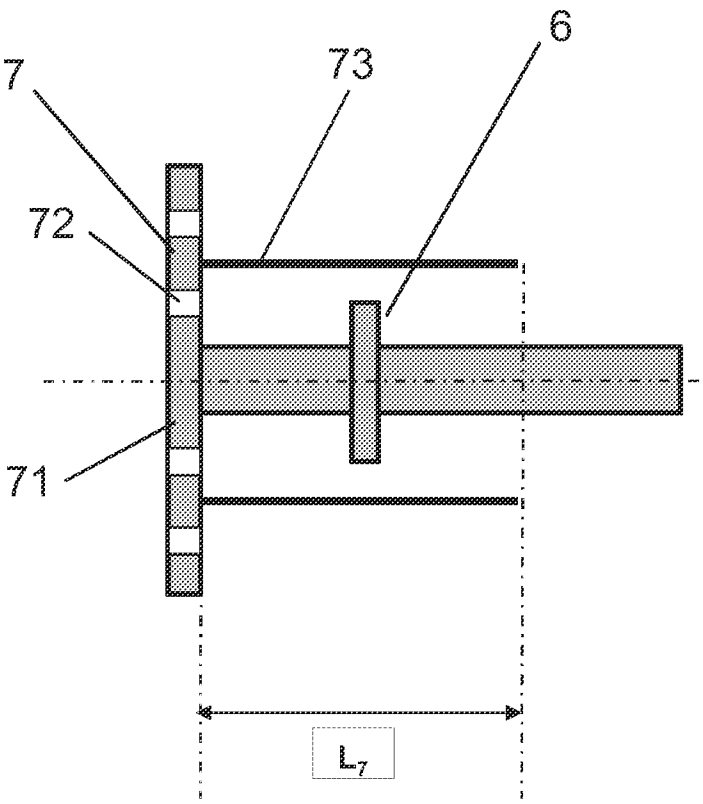
FIG. 5*a* is a cross section of the diffuser.

The diffuser 7 is illustrated in detail in FIGS. 5*a* and 5*b*. It is made up of a disc 71, of diameter D5, which is pierced with holes 72, and of a concentrator 73. The concentrator 73 has a cylindrical shape of diameter D8 and length L7. The holes 72 are disposed at different concentric diameters: D6 and D7. A series of holes 720 of diameter D6 is disposed on the exterior of the concentrator 73 and a series of holes 721 of diameter D7 is disposed in the interior of the concentrator 73. The downstream gas injection 6 is positioned inside the concentrator 73. In the example illustrated, there are only two series of holes 720, 721, but there could be more thereof.

Figure 2:
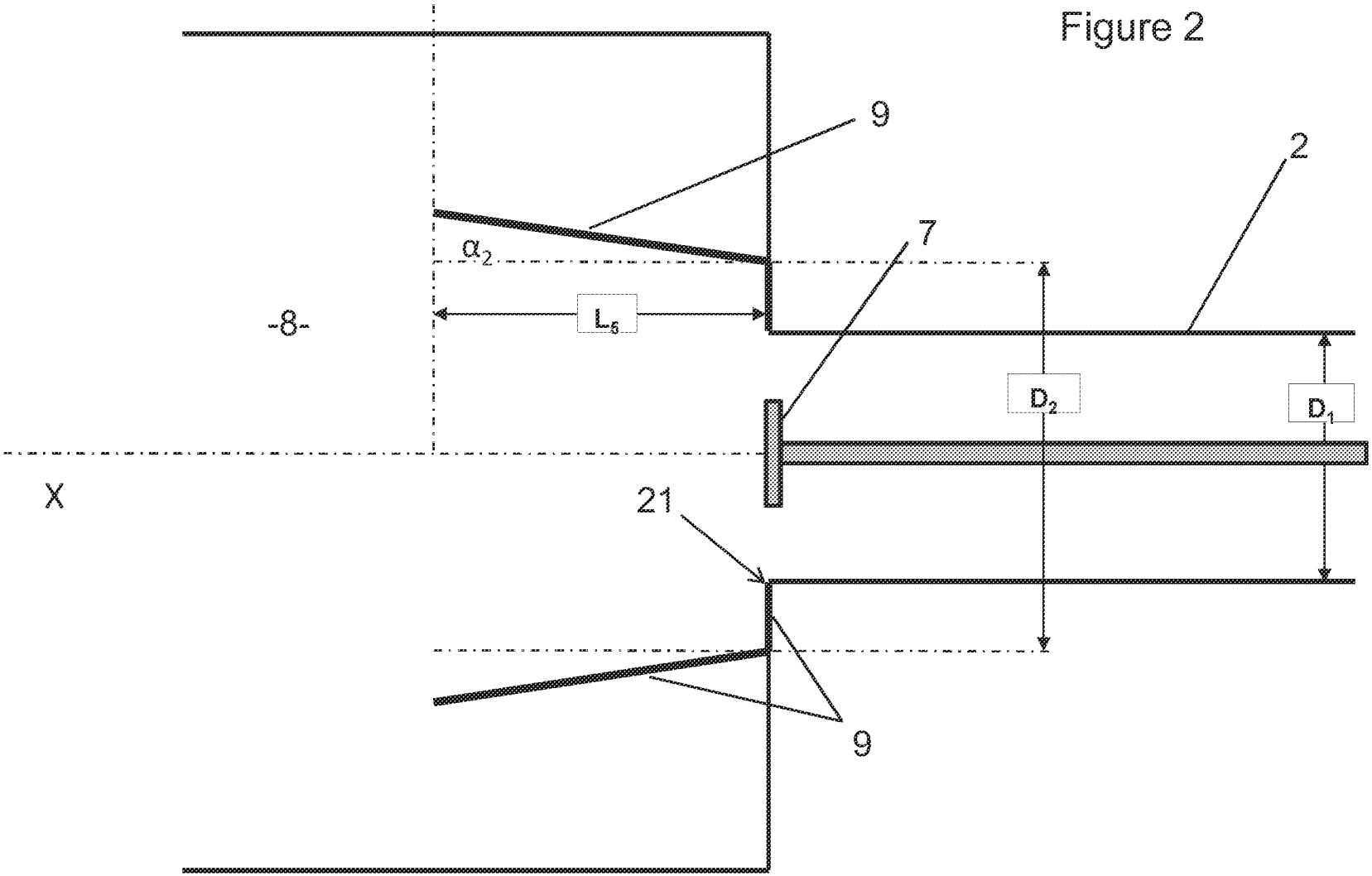
FIG. 2 is a cross section of a burner with walls for mechanically protecting the flame.

FIG. 2 shows a system for mechanically protecting the flame 82, said system being situated inside the firebox 8 and being made up of a wall 9 of conical shape of length L5 and of minimum inside diameter D2 that is situated at the downstream end 21 of the air inlet tube 2. The cone makes an angle $\alpha 2$ with respect to the axis X of the tube 2. The gas injections are not shown in this FIG. 2.

Figure 3:
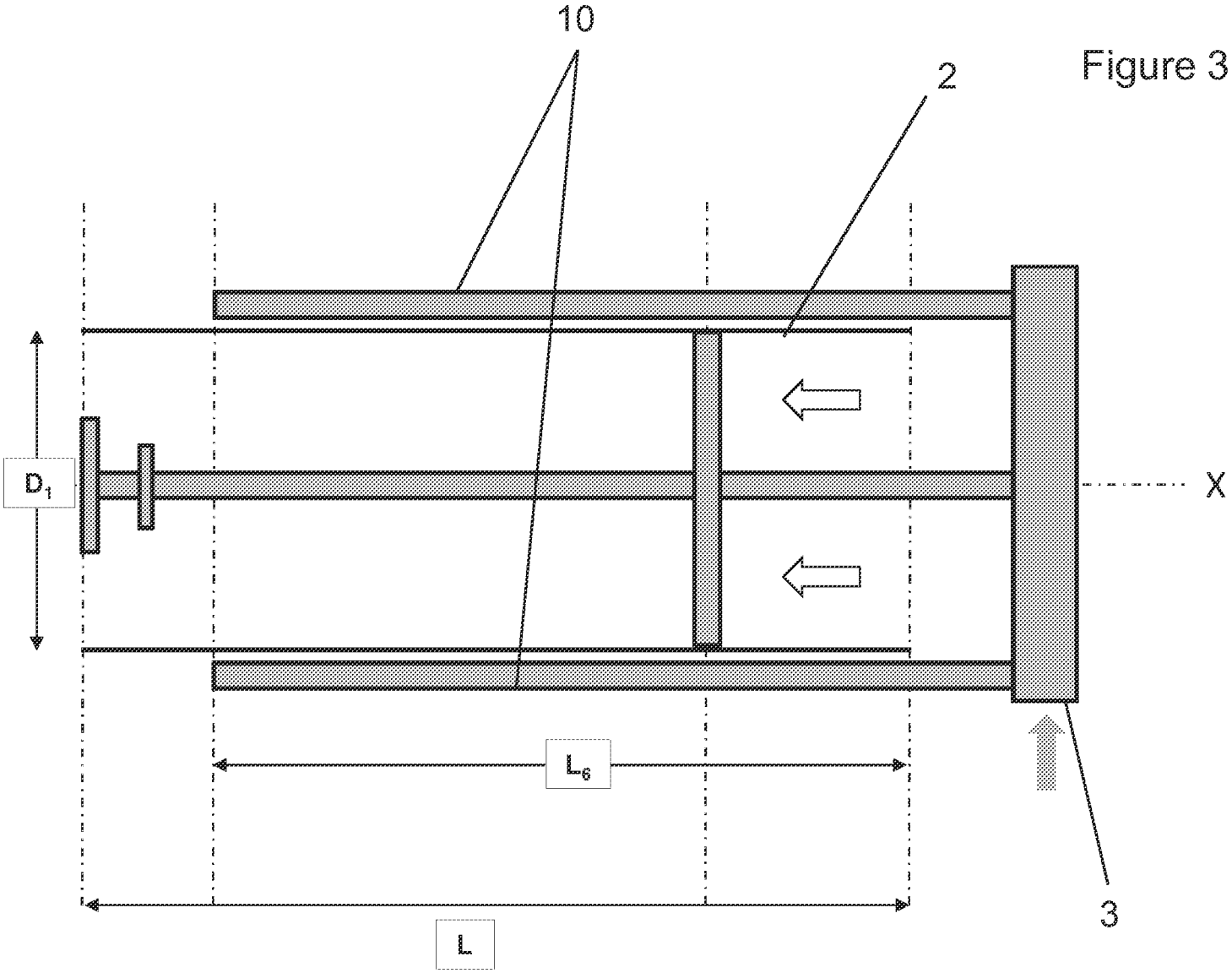
FIG. 3 is a cross section of a burner with peripheral gas injections.

Peripheral gas injections 10 are disposed at the direct outer periphery of the air inlet tube 2 in the example in FIG. 3. They are fed by the specific gas injection system 3 of the burner 1. It is better to provide preferably two injections that are symmetric with respect to the axis X so as to balance the flame 82.

In the example in FIG. 7, the elements 41 are inclined with respect to the radius of the air inlet tube 2, include gas injection holes 410, and each start from the gas inlet duct 31 and extend as far as the air inlet tube 2. They can have an aerodynamic shape.

Figure 10:
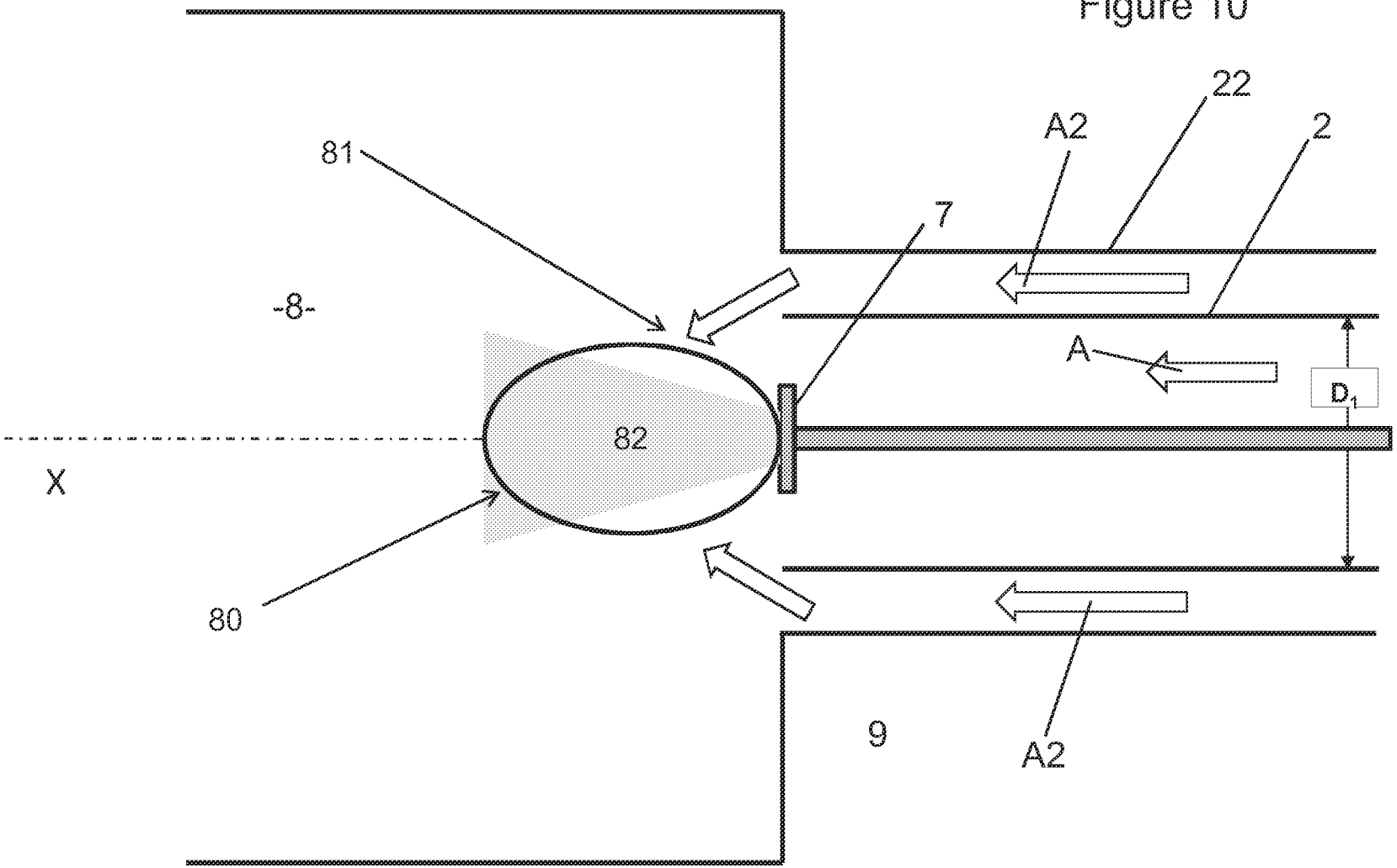
FIGS. 10 and 11 show different examples of possible settings of burners used in the applications of the minerals industry.
Figure 11:
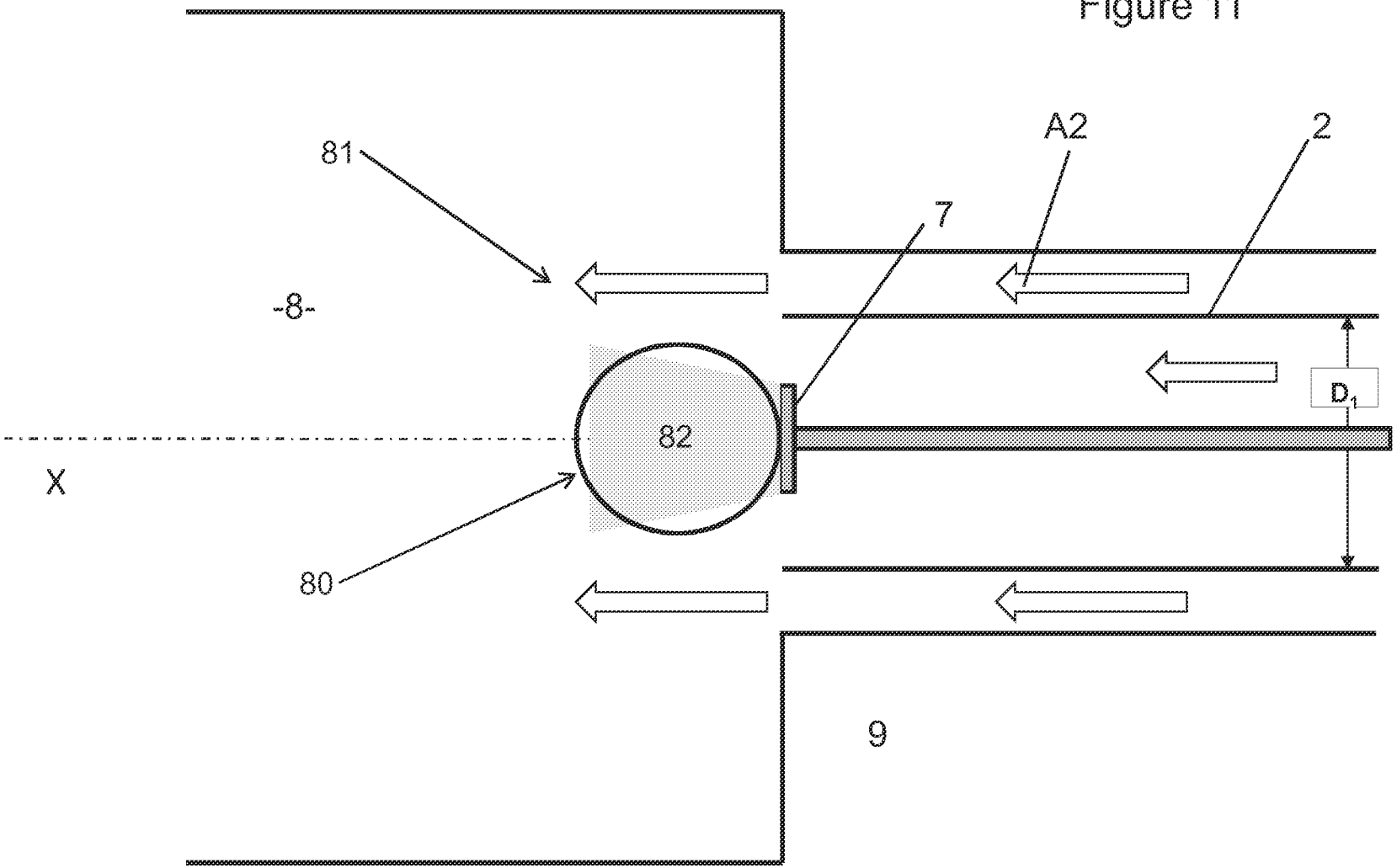

FIGS. 10 and 11 illustrate different settings of burners according to the disclosure that can be used in the minerals industry with the premix technology with air factors R. The gas injections are not shown in these two figures.

In FIG. 10, the premix is set with an air factor R of between 1 and 2. It is apparent that in this case the flame 82 is long and as a result secondary air is introduced directly into the flame 82, bringing about excess air combustion and a small quantity of NOx in the primary zone 80 and a large quantity in the secondary zone 81.

In FIG. 11, the premix is set with an air factor R of between 0.25 and 1. In this case, the flame 82 is short and, as a result, the introduction of secondary air is impeded after the flame 82, bringing about combustion with a shortage of air and a low quantity of NOx both in the primary zone 80 and the secondary zone 81, there thus being a "reburning" effect.

Figure 12A:
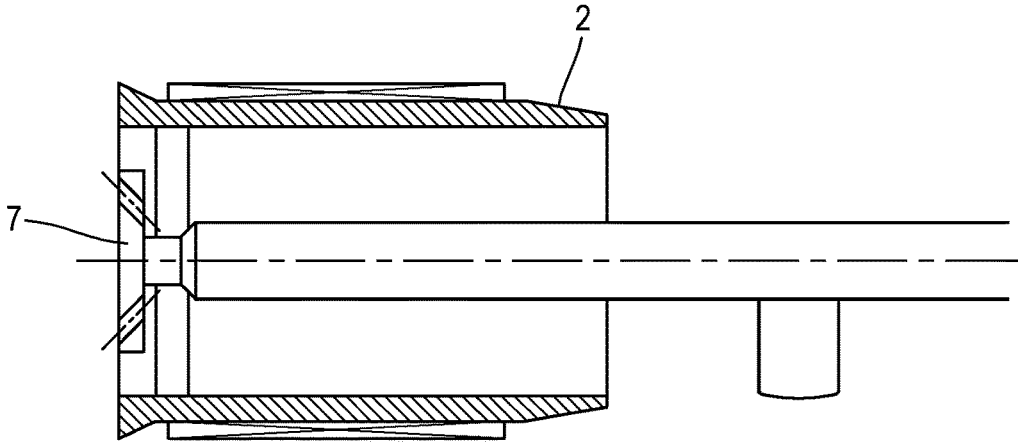
FIGS. 12*a*, 12*b* and 12*c* are examples of diffusers.
Figure 12B:
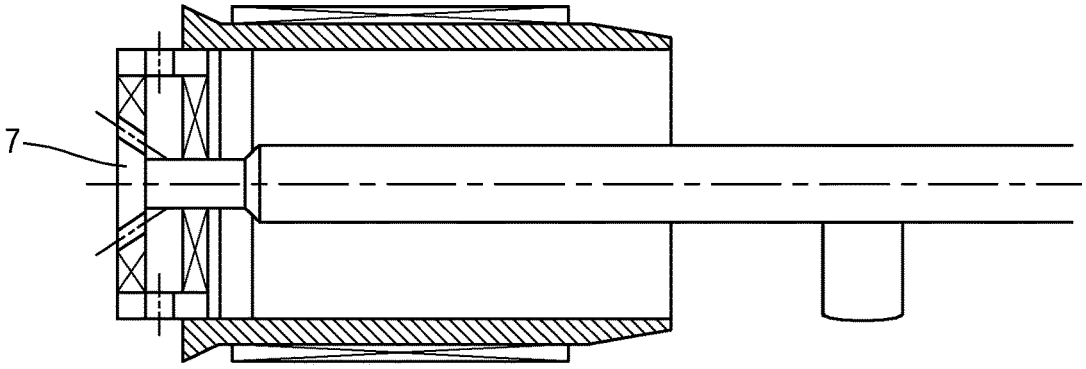
Figure 12C:
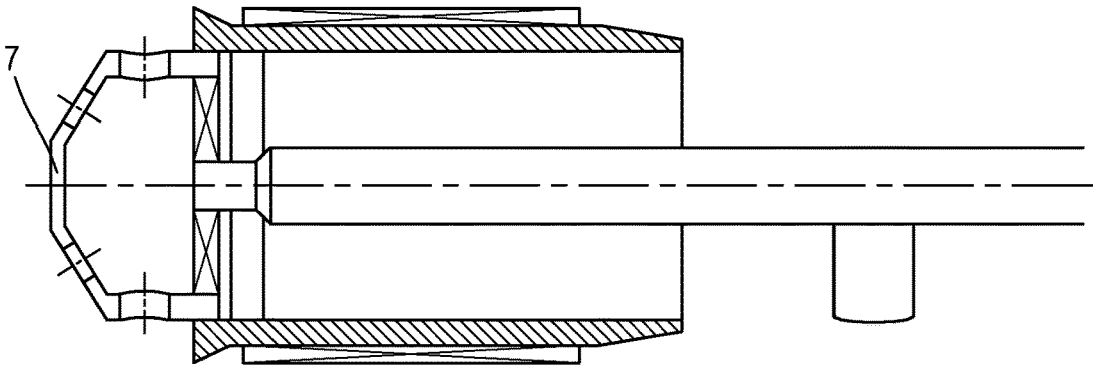

FIGS. 12*a*, 12*b* and 12*c* show different variants of diffusers 7.

Figures 8A, 8B:
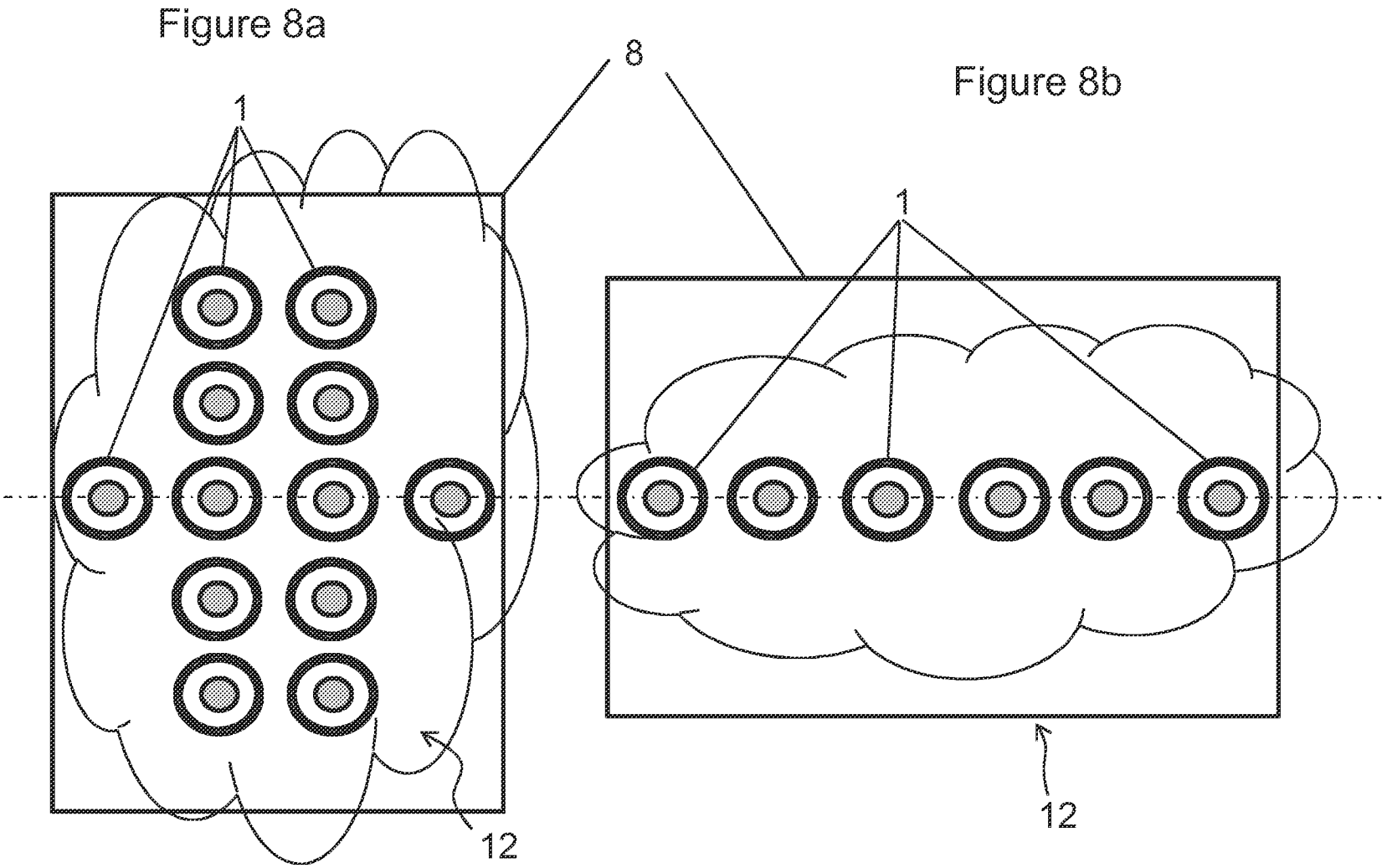
FIGS. 8*a* and 8*b* show different arrangements of burners in a set of burners according to the disclosure.
Figure 9:
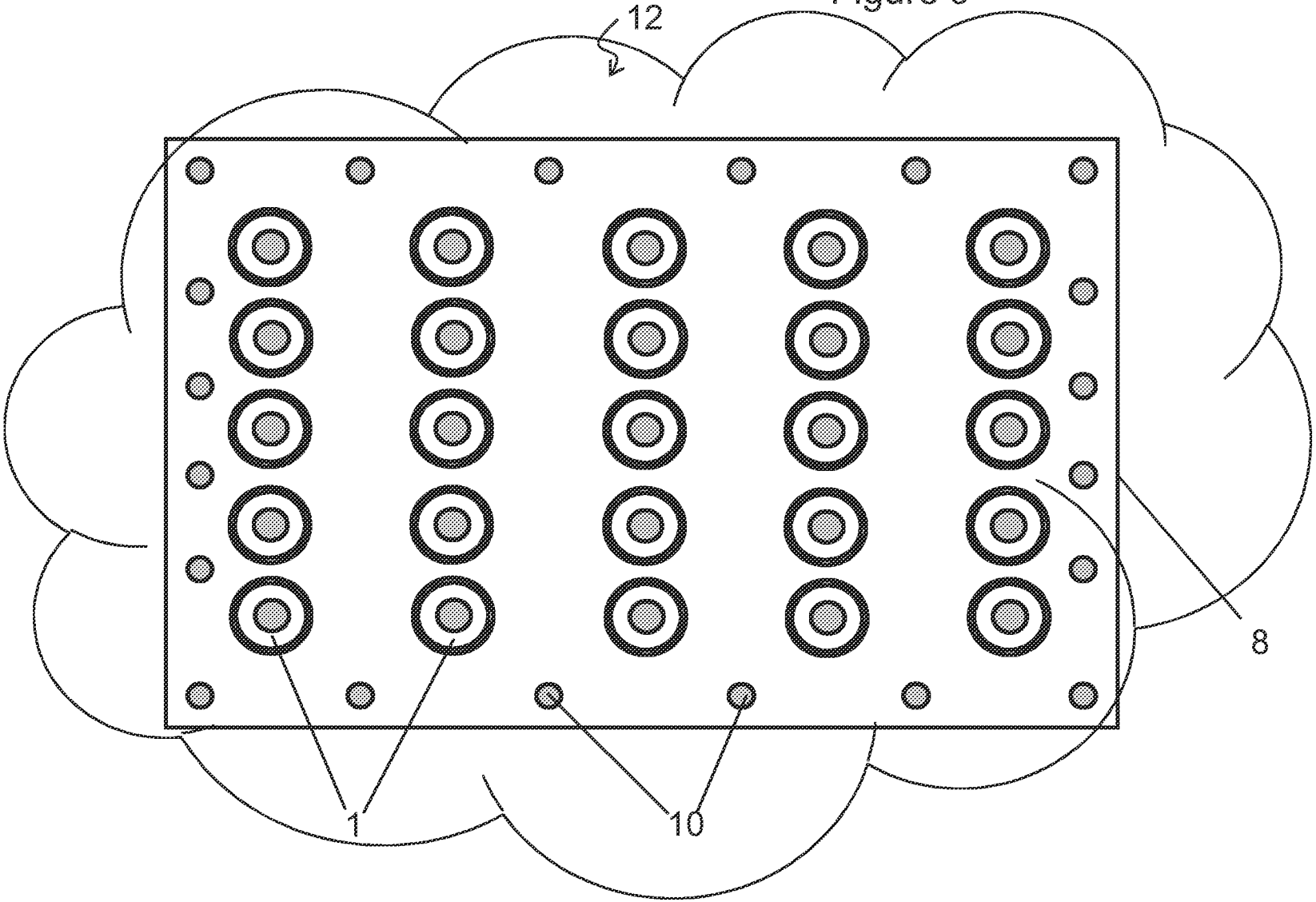
FIG. 9 is a set of burners with gas injections.

The burners 1 are disposed in a firebox 8 in different arrangements so as to constitute a set 12 of burners 1 such as those illustrated in FIG. 8*a*, 8*b* or 9. The number and arrangement of the burners in the set depend on the type of application in question and on the power desired.

In FIG. 8*a*, the burners 1 are aligned vertically in two vertical lines of five burners and two additional burners are disposed on each side at the middle so as to concentrate the flame 82.

In FIG. 8*b*, the burners 1 are aligned horizontally in a single line.

In FIG. 9, the burners 1 are aligned vertically in several vertical lines and peripheral gas injections 10 are positioned at the periphery of the firebox 8. It is possible to dispose further peripheral injections at other locations of the firebox 8.

Depending on the power desired, the number and arrangement of the burners 1 could vary. Depending on the characteristics of the combustion chamber, a minimum number of burners is necessary.

Thus, if the burner 1 has a maximum power Pmax=1 MW and a minimum power Pmin=0.2 MW, its variation in power is $$Vp=(1/0.2)=5.$$

A set 12 of nine elementary burners will have a maximum power of Pmax=9×1=9 MW.

If the minimum number of burners 1 in service that is necessary for the operation of the combustion chamber is two, the minimum power of the set of burners will be Pmin=2×0.2=0.4 MW The variation in power of the set 12 of burners will be $$Vp=9/0.4=22.5.$$

Examples for an Ultra-Low NOx 32 MW Burner

The measurements were taken with a diameter D1 of 324 mm.

The values measured are the following:

D1—diameter of the air inlet tube 2

L—length of the air inlet tube 2

L1—distance of the gas injection 4 from the upstream end 20 of the air inlet tube 2

L4—distance of the diffuser 7 from the upstream end 20 of the air inlet tube 2

D8—diameter of the concentrator 73

L7—distance of the concentrator 73 from the upstream end 20 of the air inlet tube 2

L3—distance of the downstream gas injection 6 from the upstream end 20 of the air inlet tube 2

D2—inside diameter of the wall 9

α2—angle α2 of the cone of the wall 9 with respect to the axis X of the tube 2

L6—distance of the peripheral gas injection 10 from the upstream end 20 of the air inlet tube 2

L2—distance of the mixer 5 from the upstream end 20 of the air inlet tube 2

L8—distance of the intermediate gas injection 11 from the upstream end 20 of the air inlet tube 2; if the intermediate gas injection 11 is disposed upstream of the end 20, this length is negative.

DeltaP is the difference in pressure between the burner 1 and the firebox 8.

| Dimension | Lower limit | Upper limit | Value measured | Technical result |
|---|---|---|---|---|
| L | 972 | 1944 | 1591 | NOx < 10 ppm and optimized burner cost |
| | | | 500 | NOx > 25 ppm |
| | | | 2500 | off-market burner cost |
| L1 | 162 | 1591 | 324 | NOx < 10 ppm and DeltaP < 250 mmCE |
| | | | 50 | DeltaP > 250 mmCE |
| Element 40 of axis x/x' | 2 | — | 3 | NOx < 10 ppm and optimized burner cost |
| | | | 1 | Nox > 25 ppm |
| No of holes per element 40 of axis x/x' | — | — | 20 | NOx < 10 ppm |
| | | | 10 | NOx > 25 ppm |
| L4 | 1267 | 1591 | 1591 | NOx < 10 ppm and CO < 20 ppm |
| | | | 1000 | NOx > 25 ppm and CO < 10 ppm |
| Cross section of diffuser 7 ($mm^2$) | — | 39661 | 15837 | DeltaP < 250 mmCE |
| | | | 45239 | DeltaP > 250 mmCE |
| D8 | 37 | 78 | 58 | stability of flame with R > 2 = YES |
| | | | 30 | stability of flame with R > 2 = NO |
| L7 | 0 | 142 | 50 | stability of flame with R > 2 = YES |
| | | | 200 | non-optimized burner cost |
| L3 | 1429 | 1591 | 1571 | stability of flame with R > 2 = YES |
| | | | 1200 | stability of flame with R > 2 = NO |
| D2 | 324 | 1620 | 1296 | CO < 100 mg/Nm3 at 3% |
| | | | 1944 | O2 weakening of mechanical integrity |
| α2 | 0 | 20° | 7° | CO < 100 mg/Nm3 at 3% |
| | | | 30° | O2 stability of flame = NO |
| L6 | 0 | 648 | 324 | NOx < 10 ppm |
| | | | 972 | weakening of air tube mechanical integrity |
| L2 | 0 | 1591 | 644 | NOx < 10 ppm |
| | | | no mixer | NOx > 10 ppm |
| Cross section of mixer 5 ($mm^2$) | — | 39661 | 31729 | DeltaP < 250 mmCE |
| | | | 55525 | DeltaP > 250 mmCE |
| L8 | 0 | — | 50 | NOx < 10 ppm and DeltaP < 250 mmCE |
| | | | −20 | DeltaP > 250 mmCE and risk of gas injection into air box (values in mm) |

The invention claimed is:

1. Premix burner, comprising:

an air inlet tube of length L; and a single specific gas injection system;

wherein said gas injection system comprises:

an upstream gas injector, a mixer, a downstream gas injector situated at a distance L3 from an upstream end of the air inlet tube, and a diffuser;

wherein the gas injection system constitutes a one-piece mechanical assembly that ensures a self-stable elementary flame;

wherein the upstream gas injector comprises a single mechanical component configured to ensure both gas injection and mixing; and wherein the diffuser comprises a stabilizing element of diameter D5 and a concentrator of diameter D8 and length L7, the stabilizing element is pierced by holes distributed in two concentric circles of diameters D6 and D7, D7<D8<D6, and the length L7 is between 0 and D5.

2. Burner according to claim 1, wherein the air inlet tube has a length L and a diameter D1 such that the length L is between three and six times the diameter D1.

3. Burner according to claim 1, wherein the upstream gas injector is situated at a distance L1 from an upstream end of the air inlet tube of between 0.5 times a diameter D1 of the air inlet tube and the length L.

4. Burner according to claim 1, wherein the upstream gas injector comprises at least two elements of axes x and x' that are disposed radially with respect to the air inlet tube, each element having gas injection holes disposed along its axis.

5. Burner according to claim 1, wherein the upstream gas injector comprises at least two mixing elements of axes y and y' that are inclined with respect to the radius of the tube and connect the air inlet tube and the gas injection duct, and wherein each mixing element has gas injection holes (410) disposed along its axis y or y'.

6. Burner according to claim 2, wherein the diffuser is situated at a distance L4 from an upstream end of the air inlet tube of between 2/3L and L.

7. Burner according to claim 1, wherein the diffuser has a cross sectional area smaller than or equal to 0.5 times the cross section of the air inlet tube.

8. Burner according to claim 6, wherein the downstream gas injection is situated at a distance L3 from an upstream end of the air inlet tube of between 2/3L and L.

9. Burner according to claim 1, wherein the air inlet tube is prolonged by walls for mechanically protecting the flame.

10. Burner according to claim 1, wherein the air inlet tube is prolonged by walls for mechanically protecting the flame have a diameter D2 of between the diameter D1 of the air inlet tube and 5×D1.

11. Burner according to claim 9, wherein the walls for mechanically protecting the flame have an inclination angle $\alpha$2 with respect to the axis of the burner of between 0° and 20°.

12. Burner according to claim 1, wherein the air inlet tube has a diameter D1, and a peripheral gas injection is situated at a distance L6 from an upstream end of the air inlet tube such that: $0 \leq (L-L6) \leq 2*D1$.

13. Burner according to claim 1, wherein the mixer is situated at a distance L2 from an upstream end of the air inlet tube such that: $(L-L3) \leq (L-L2) \leq L$.

14. Burner according to claim 1, wherein the mixer has a cross sectional area smaller than or equal to 0.5 times the cross section of the air inlet tube.

15. Burner according to claim 1, further comprising a secondary air tube of diameter D4 that is concentric with the air tube of diameter D1 such that D4>D1.

16. Burner according to claim 1, wherein an intermediate gas injection is situated at a distance L8 from the upstream end of the air inlet tube such that L8>0.

17. Set, comprising a number Nmax of burners according to claim 1.

18. Set according to claim 17, wherein the number Nmax of burners deliver a power of between Pmax and Pmin, wherein the set is able to function with a number Nmin of burners, and wherein its power is variable depending on the number N of burners in operation, such that its variation in power $Vp=(Nmax \times Pmax)/(Nmin \times Pmin)$.

19. Set of burners according to claim 17, further comprising m peripheral gas injections, such that m>1.

* * * * *